US005358118A

United States Patent [19]

Thompson et al.

[11] Patent Number: 5,358,118

[45] Date of Patent: Oct. 25, 1994

[54] STEPPED EDGE BLISTER PACK

[75] Inventors: Andrew R. Thompson, Swindon; Ray W. Marshall, Romford, both of England

[73] Assignee: R.P. Scherer Corporation, Troy, Mich.

[21] Appl. No.: 198,644

[22] Filed: Feb. 18, 1994

Related U.S. Application Data

[63] Continuation of Ser. No. 954,888, Sep. 30, 1992, abandoned.

[51] Int. Cl.[5] ..... B65D 83/04

[52] U.S. Cl. ..... 206/538

[58] Field of Search ..... 206/532, 538

[56] References Cited

U.S. PATENT DOCUMENTS

| | | | |
|---|---|---|---|
| 3,311,229 | 3/1967 | Troll et al. . | |
| 3,452,367 | 10/1969 | Hellstrom . | |
| 3,472,367 | 10/1969 | Hellstrom . | |
| 3,630,346 | 12/1971 | Burnside | 206/539 X |
| 3,933,245 | 1/1976 | Mullen . | |
| 3,941,248 | 3/1976 | Moser et al. . | |
| 4,294,361 | 10/1981 | Margulies et al. . | |
| 4,305,502 | 12/1981 | Gregory et al. . | |

*Primary Examiner*—William I. Price

*Attorney, Agent, or Firm*—Allegretti & Witcoff, Ltd.

[57] ABSTRACT

A stepped-edge blister pack for containing and dispensing unit doses of medication such as capsules, tablets, caplets or fast-dissolving dosage forms (FDDF) is disclosed. The invention is comprised of a base sheet and a substantially planar lidding sheet. The base sheet has a plurality of blister compartments and a plurality of steps along its edges, one step being adjacent to each blister compartment. The substantially planar lidding sheet is peelably sealed to the base sheet except at extended edge regions, thus forming edge peel tabs, and the lidding sheet is scored with lines of weakening about each blister compartment. The steps along the edges underlay the unsealed extended edge regions of the lidding sheet, thus providing a series of finger accesses to thereby ease the process of grasping a given edge peel tab and ultimately opening a given blister compartment. The invention is particularly useful for patients whose dexterity skills are reduced as a result of age, infirmity or chronic conditions such as arthritis. Further, the stepped edges of the present invention reduce undesired edge undulation that is caused by the presence of an extended unsealed edge peel tab. Thereby, certain problems in machine feeding and coding are reduced.

7 Claims, 2 Drawing Sheets

Fig. 4
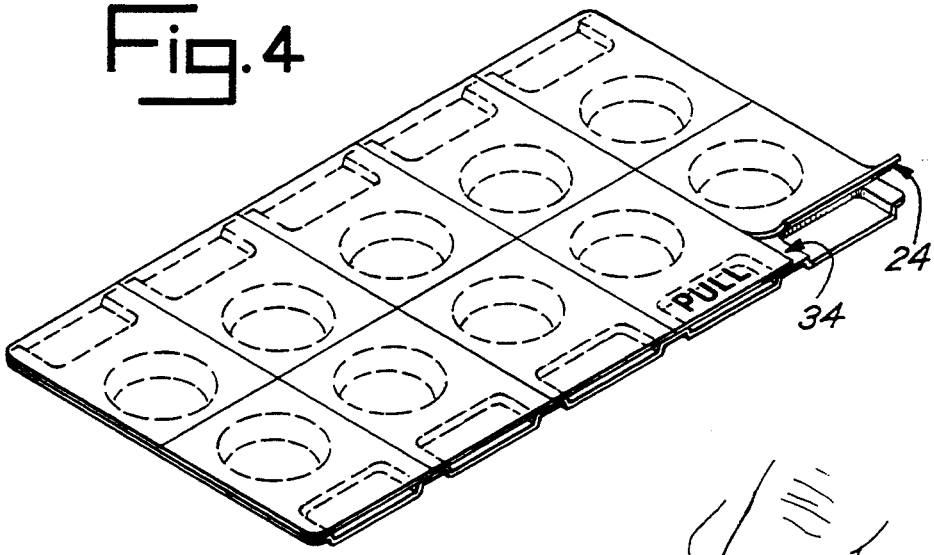
Fig. 5
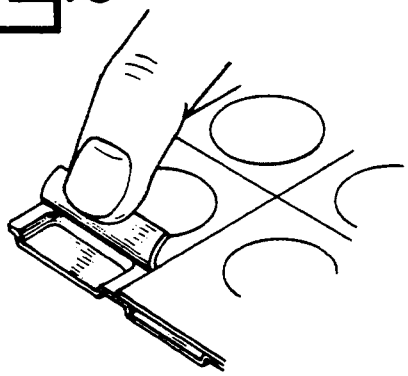
Fig. 6
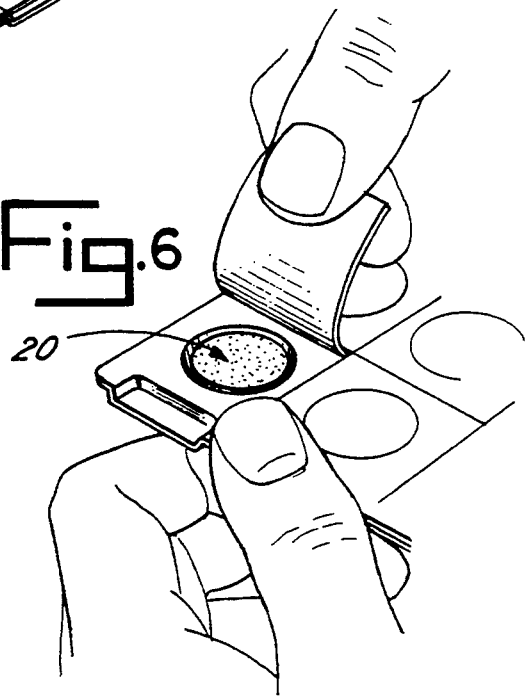
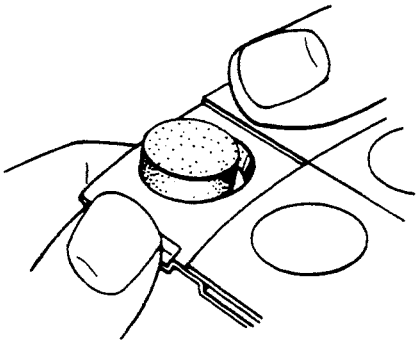
Fig. 7
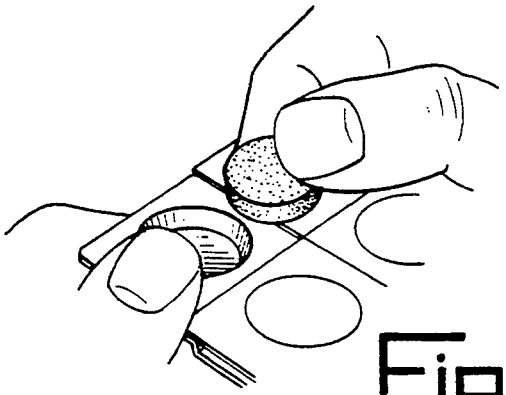
Fig. 8

STEPPED EDGE BLISTER PACK

This application is a continuation application of Ser. No. 07/954,888, filed Sep. 30, 1992 and now abandoned.

BACKGROUND OF THE INVENTION

The present invention relates to blister packaging, such as for the containment and dispensing of fast-dissolving dosage form (FDDF) drug formulations or other forms of medication. More particularly, the present invention relates to a stepped edge blister pack having an enlarged unsealed stepped tab at an edge adjacent to each blister pocket, thus allowing for ease of opening and for reinforcement and accordingly the prevention of undesired undulation.

Medication in forms such as tablets, capsules or caplets has been typically packaged in blister packages or sheets of multiple blister compartments. A base sheet of transparent or opaque plastic, for instance polyvinyl chloride (PVC or PVC type laminates), has a plurality of blister compartments projecting from one face thereof, for containing the unit dosages of medication. Solid units of medication may be deposited into the blister compartments of the base sheet. Alternatively, as explained by Gregory et al., U.S. Pat. No. 4,305,502, the medication may be closed and frozen within the plastic sheet and then dried using a freeze-drying process. Preferably, a liquid suspension is dosed into the pre-formed blister compartments of the base sheet. The base sheet containing the suspension is then cooled by a medium such as liquid nitrogen or carbon dioxide, thereby freezing the contents of the blister compartments. The frozen contents may then be subjected to reduced pressure to complete the freeze drying process.

Finally, a lidding or cover sheet typically comprised at least in part of aluminum foil, is peelably sealed, preferably by a heat sealing process, to the top of the base sheet and perforated about each blister compartment, thus removably enclosing the medication.

To permit the cover sheet over an individual blister compartment to be peeled from the respective portion of the base sheet, a small portion of the edge of the cover sheet may be left unsealed to the base sheet, adjacent to each blister compartment. A patient may thus grasp the unsealed edge and accordingly peel the cover sheet from the base sheet to reveal a unit of medication. For instance, the above-mentioned Gregory et al. patent discloses a pharmaceutical dosage form package comprised of a filmic base sheet having depressions, and a covering sheet adhered to the base sheet except at side portions adjacent to each depression. The Gregory specification states that in those portions, "the covering sheet is not adhered to the filmic material so that the user may start peeling away the covering sheet at these locations." (Col. 4, lines 64–66.)

Recently, developments in the medical field have necessitated an increase in the size of the edge peel tab to allow patients with dexterity difficulties a larger tab to grip and peel. Extending the size of the edge peel tab, however, has been seen to result in blister packs that have severe edge undulation due to uneven shrinkage after the heat sealing process and that are difficult to peel in part due to the tendency of the cover sheet to stick to the plastic base sheet as a result of heat transfer.

Prior art blister packs have never before combined the advantages present in the present invention. This invention presents a blister pack comprised of a base sheet having a plurality of blister compartments formed therein, and also a plurality of extended steps formed in and at the edges thereof, each step being adjacent to one of the blister compartments. A substantially planar lidding foil preferably coterminous with the base sheet is peelably sealed to the base sheet, thus enclosing the blister compartments and providing an edge tab at each step adjacent to each blister compartment. The stepped edge of the base sheet provides useful finger accesses through which each edge tab may be grasped. By grasping the edge tab of the lidding foil at the finger access formed by a step and by peeling the lidding foil from a given blister compartment, a patient may dispense the contents of the given compartment. An extended edge peel tab with a stepped-base feature will thus ease the mechanism by which the package is opened and will accordingly assist in patient compliance.

There is shown in the existing art various forms of blister packs, none of which embodies all of the features and advantages of the present invention. The Moser et al. reference, U.S. Pat. No. 3,941,248, for instance, discloses a tear-open package for tablets comprised of a lower base foil, a cover foil and "grasping recesses" for grasping and removal of the cover foil. Moser does not disclose a stepped-edge configuration like that of the present invention. Rather, the "grasping recesses" of Moser are concealed interiorly beneath the cover foil and cannot be easily reached until an individual tablet package is severed from the overall package or until a centrally positioned strip is severed from the overall package.

Mullen, U.S. Pat No. 3,933,245, discloses an article holding and dispensing container comprised of a tray of blister compartments and a closure means heat-sealed to the tray. The tray and closure means are each scored with horizontal and vertical score lines, thus allowing each individual blister to be severed from an adjacent blister. At each intersection of score lines is a preferably circular depressed area, at which point there is an absence of heat-sealing. Thus, the sheet covering an individual blister can be peeled off either (i) by grasping the sheet at the intersection of the adjacent horizontal and vertical score lines or (ii) by detaching the blister from adjacent blisters and then grasping the sheet at the area of depression. In contrast, the cover sheet in the present invention can be peeled from an individual blister by simply grasping the edge-tab at the finger access and pulling the cover sheet away from the base sheet.

Hellstrom, U.S. Pat. No. 3,472,367, discloses a quick-opening package comprised of a relatively stiff supporting layer, at least one pocket formed in the supporting layer, and a backing layer adhered to the supporting layer. In order to open the enclosed pocket, the package is bent along a line crossing the pocket, thereby rupturing the backing layer over the pocket. The supporting layer is preferably reinforced with a series of flutes or ridges to ensure that the bending occurs in the proper position relative to the pocket. Further, Hellstrom discloses a process of manufacturing this quick-opening package, wherein pockets and flutes are simultaneously stamped onto a continuous strip of blister material, a backing layer is applied, and the resulting strip can be severed or fed from a strip dispenser. The present invention differs from Hellstrom in that the blister compartments of the present invention are not opened by bending the package and rupturing a given blister; rather, a blister compartment made in accordance with the present invention would be opened by peeling the cover sheet from the base sheet, after accessing the cover sheet from the stepped peel tab at the edge of the pack.

Finally, as mentioned above, Gregory et al., U.S. Pat. No. 4,305,502, discloses a pharmaceutical dosage form package comprised of a plastic film blister sheet with depressions for receiving dosage forms, and a laminate cover sheet adhered to it except at edge peel tab areas. The surface of the cover sheet is scored to allow access to the enclosed dosage forms, which are formed in place by freeze-drying. Importantly, the Gregory package does not disclose the stepped edges and associated ease of peeling and reduced edge undulation that is achieved by the present invention.

SUMMARY OF THE INVENTION

The present invention relates to an edge peel blister pack having improved ease of opening and reduced undulation. It is therefore an object of the present invention to provide a means for easing the peelability of the edge peel tabs on a blister pack by providing a stepped edge to the blister pack.

A further object of the present invention is to reduce undulation at the unsealed edge of the blister pack by strengthening the edge with one or more steps or recesses, thereby reducing machine feeding problems and significantly improving pack appearance.

Another object of the present invention is to prevent the cover sheet from sticking to edge of the base sheet during sealing, and accordingly to provide adequate finger access, by including an extended stepped edge adjacent to each blister compartment.

Further objects and advantages of the present invention will become apparent in the following description.

DETAILED DESCRIPTION OF THE DRAWINGS

There is shown in the attached drawings a presently preferred embodiment of the present invention, wherein like numerals in the various views refer to like elements and wherein:

FIG. 4 is a perspective view of the stepped edge blister pack;

FIG. 5 is a partial perspective view of the stepped edge blister pack, illustrating the grasping of an edge tab and the peeling of the lidding foil from the blister sheet;

FIG. 6 is a partial perspective view of the stepped edge blister pack, illustrating the completion of the peeling of the lidding foil from the blister sheet; and FIG. 7 is a partial perspective view of the stepped edge blister pack, illustrating the dispensing of a unit of medication from the blister pocket.

FIG. 8 is a partial perspective view of the stepped edge blister pack, illustrating the removal of a unit of medication from the blister pocket.

DETAILED DESCRIPTION OF THE PREFERRED EMBODIMENT

Figure 1:
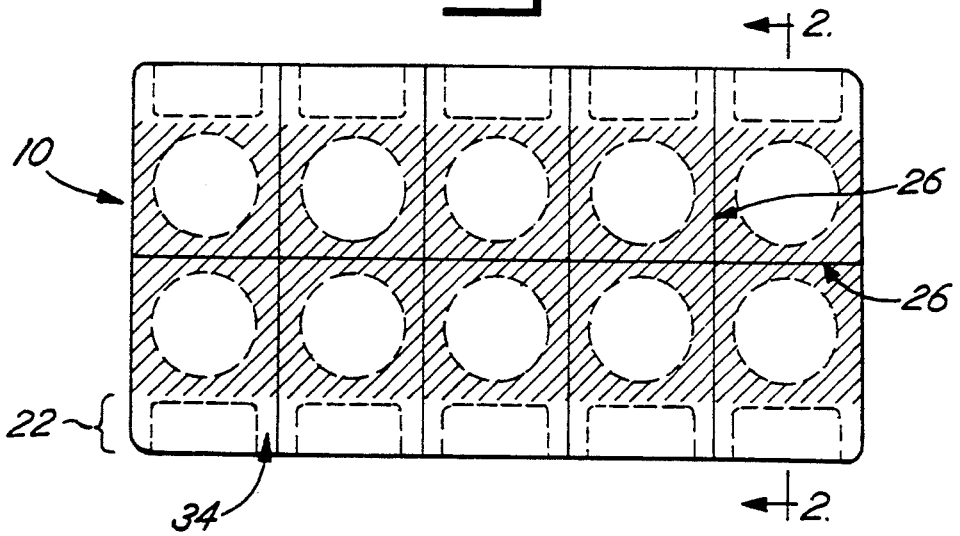
FIG. 1 is a plan view of a stepped edge blister pack made in accordance with the present invention.
Figure 2:
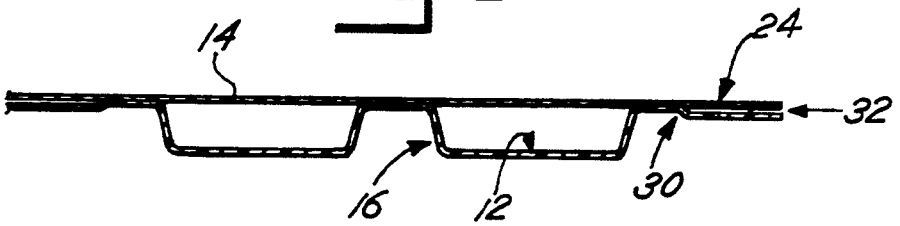
FIG. 2 is a perspective view of the blister sheet portion of the stepped edge blister pack.
Figure 3:
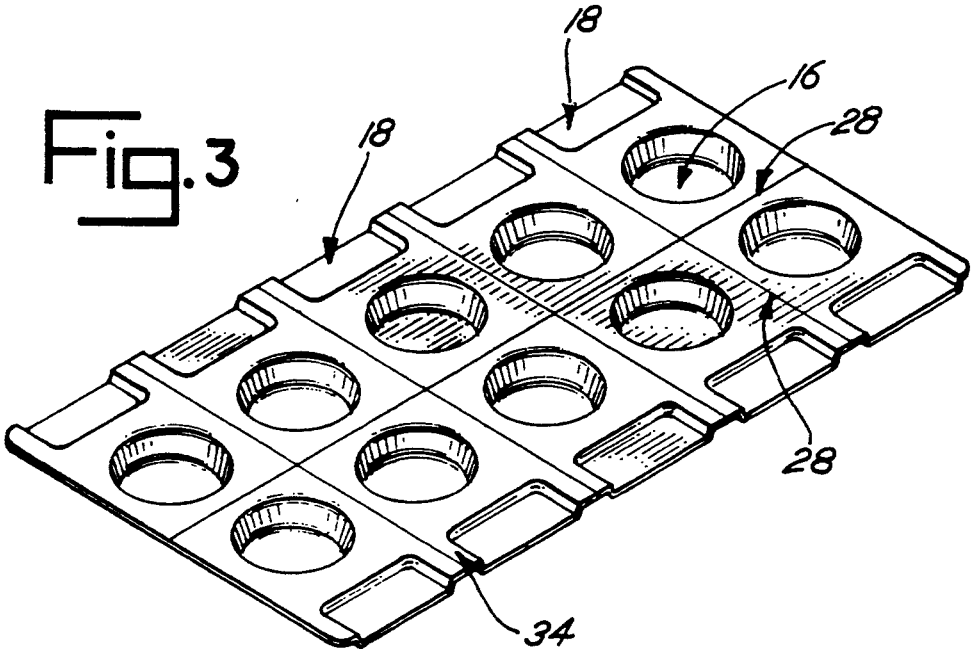
FIG. 3 is a side elevation view of a portion of the stepped edge blister pack.

FIG. 1 shows a plan view of a stepped edge blister pack 10 made in accordance with the present invention. Depicted is a ten unit blister pack, although any commercially practicable number of units may be grouped in a single blister pack. FIG. 2 shows a cross sectional view of the blister pack taken generally along the line 2—2. FIG. 3 depicts a perspective view of a blister sheet made in accordance with the present invention, wherein a cover sheet has yet to be peelably sealed to the blister sheet. FIG. 4 is a perspective view of a completed stepped edge blister pack. FIGS. 5–7 illustrate the sequence of steps that would be used to open an individual blister unit and to thus dispense the unit dosage form located within the blister.

Referring first to FIGS. 1 and 2, in the preferred embodiment, blister pack 10 comprises a blister sheet 12 and a lidding sheet 14. At least one but preferably a plurality of depressions or blister compartments 16 extend from the plane of the blister sheet, and a same number of stepped recesses 18 are positioned at the edge of the blister sheet, one stepped recess being adjacent to each blister compartment. The blister sheet may be made of any of a variety of translucent or opaque plastics such as polyvinyl chloride (PVC), PVC and PVdC (polyvinyl dichloride), polythylenc PVC/PVdC/polyethylene, PVC/Aclar and cold formed aluminum materials. Within each blister compartment is a unit dosage form 20. The dosage form may be a preselected quantity of a pharmaceutical prepared by lyophilization (freeze-drying), resulting in a fast-dissolving dosage form (FDDF). Conventional dosage forms such as tablets, capsules, caplets or the like, may also easily be contained within the blister compartments.

The unit dosage forms are retained within the blister compartments 16 by the lidding sheet 14. The lidding sheet may be comprised of any of a variety of materials such as polyester laminates, aluminum foil, aluminum/-ester laminates, paper, paper/aluminum laminates, and other related materials. The lidding sheet is substantially planar and preferably coterminous with the blister sheet. As illustrated by the shaded areas in FIG. 1, the lidding sheet is preferably scaled to the blister sheet by heat sealing, but remains unsealed at an extended edge area 22 adjacent to each blister compartment. This unsealed edge area 22 serves as a peel tab 24 to facilitate the ultimate removal of the lidding sheet from a given blister compartment as shown in FIG. 4. As is shown in FIGS. 1 and 4, the lidding sheet is scored with preferably horizontal and vertical perforated lines or other lines of weakening 26 about each blister compartment, thereby allowing the lidding sheet to be removed from an individual blister compartment while retaining the sealed cover over the remaining compartments. As shown in FIG. 3, it is possible, in addition, to score the blister sheet along identical lines 28, thus permitting an entire individual blister compartment pack to be severed from the overall pack.

As noted above, access to a given blister compartment on a typical edge peel blister pack may be made feasible by leaving a small portion of the edge of the cover sheet unsealed to the edge of the blister sheet, thus creating an edge peel tab 24. This tab may be marked with an appropriate label as illustrated in FIG. 4. A patient grips the unsealed tab and pulls back and upwardly on the cover sheet, thereby removing the cover sheet from the blister compartment. The present invention significantly eases access to the edge peel tab 24, by providing the stepped edge 30 and finger access 32 illustrated in FIG. 2. In particular, a step is formed in and at the edge of the base sheet adjacent to each blister compartment. Thus, where the lidding sheet covers each given stepped recess, a separate finger access 32 is formed for grasping the edge peel tab 24 adjacent to a given blister compartment. Each step runs only partially along the edge of the blister pack, thus leaving at least a portion 34 of each edge unstepped. Further, in the preferred embodiment, at least two opposing edges of the blister pack are stepped, in order to provide support during machine feeding and handling.

In order to additionally ease access to a given blister compartment, the present invention includes an extended edge peel tab. This feature is particularly aimed at users whose dexterity skills are reduced, such as the elderly, the infirm, or people suffering from chronic conditions such as arthritis. In so extending the unsealed edge 22 of the blister pack, however, it has been seen that severe edge undulation results in the blister sheet, causing unsightly pack appearance and difficulties in machine feeding and coding. The stepped edges 30 of the present invention, together with the unstepped edge portion or portions 34, significantly reduce this undesirable edge undulation and thereby reduce processing difficulties.

FIGS. 5–7 illustrate the process by which a unit dosage is accessed in the preferred embodiment of the present invention. The patient inserts a finger at the finger access 32 beneath the edge-peel tab 24. The patient then grasps the edge-peel tab and pulls back and upwardly on the lidding sheet, tearing along the lines of weakening 26 and thereby removing the lidding sheet from the individual blister compartment. The patient may then dispense the unit dosage 20 by inverting the pack or by depressing the underside of the blister compartment.

While a preferred embodiment of the present invention has been depicted and described, it will be appreciated by those skilled in the art that many modifications, substitutions and changes may be made thereto without departing from the true spirit and scope of the invention.

What is claimed is:

1. A multi-unit blister pack having an assembled state comprising, in combination:

a base sheet having a substantially rectangular shape defining a base plane and defined by first and second ends and first and second edges, said base sheet including first and second rows of blister pockets extending between said first and second ends substantially parallel to said first and second edges to define corresponding pairs of blister pockets extending between said first and second edges substantially parallel to said first and second ends, said base sheet further including opposed pairs of spaced stepped edge portions along said first and second edges, respectively, each of said opposed pairs substantially aligning with one of said corresponding pairs, said blister pockets and said spaced stepped edge portions extending in the same direction from said base plane, said opposed pairs of said spaced stepped edge portions providing first and second opposed corrugated strengthening external edges in said assembled state structurally reinforcing said multi-unit blister pack; and a lidding sheet substantially corresponding in shape to said base sheet and peelably adhered thereto to close said blister pockets and to cover said spaced stepped edge portions, said lidding sheet providing free tab portions over each of said spaced stepped edge portions, said lidding sheet including a plurality of tear lines extending between said first and second edges substantially equally spaced between said corresponding pairs of said blister pockets and a removal line extending between said first and second ends of said base sheet substantially equally spaced between said first and second rows, said tear lines and said removal line dividing said lidding sheet into a plurality of pocket portions corresponding to said blister pockets;

said spaced stepped edge portions, said free tab portions, said tear lines and said removal line cooperating to define means for individually removing one of said pocket portions in said assembled state and opening one of said blister pockets by pulling said free tab portion towards said one of said blister pockets.

2. A multi-unit blister pack as claimed in claim 1 wherein said lidding sheet is peelably adhered to said base sheet up to said first and second opposed corrugated strengthening external edges.

3. A multi-unit blister pack as claimed in claim 1 wherein said base sheet includes a plurality of weakening lines substantially aligned with said tear lines and said removal line of said lidding sheet in said assembled state.

4. A multi-unit blister pack as claimed in claim 3 wherein said lidding sheet is peelably adhered to said base sheet up to said first and second opposed corrugated strengthening external edges.

5. A multi-unit blister pack as claimed in claim 1 wherein each of said spaced stepped edge portions is defined by three side walls substantially perpendicular to said base plate and a bottom wall substantially parallel to said base plane.

6. A multi-unit blister pack as claimed in claim 5 wherein said base sheet includes a plurality of weakening lines substantially aligned with said tear lines and said removal line of said lidding sheet in said assembled state.

7. A multi-unit blister pack as claimed in claim 6 wherein said lidding sheet is peelably adhered to said base sheet up to said first and second opposed corrugated strengthening external edges.

* * * * *